US008208603B2

(12) United States Patent
Sato

(10) Patent No.: US 8,208,603 B2
(45) Date of Patent: Jun. 26, 2012

(54) X-RAY GENERATING DEVICE

(75) Inventor: Genta Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 12/840,141

(22) Filed: Jul. 20, 2010

(65) Prior Publication Data

US 2011/0026680 A1 Feb. 3, 2011

(30) Foreign Application Priority Data

Jul. 28, 2009 (JP) ..... 2009-175392

(51) Int. Cl.
*H01J 35/00* (2006.01)

(52) U.S. Cl. ..... 378/119

(58) Field of Classification Search ..... 378/119, 378/121, 134, 136, 137, 138, 143, 144
See application file for complete search history.

(56) References Cited

U.S. PATENT DOCUMENTS

2005/0063514 A1* 3/2005 Price et al. ..... 378/119

FOREIGN PATENT DOCUMENTS

JP 08-096986 A 4/1996
JP 11-258400 A 9/1999

* cited by examiner

*Primary Examiner* — Courtney Thomas

(74) *Attorney, Agent, or Firm* — Canon U.S.A., Inc. IP Division

(57) ABSTRACT

An X-ray generating device includes an electron-beam generator, a target assembly group, and an electron-beam focusing unit. The electron-beam generator generates electron beams. The target assembly group includes a plurality of target assemblies that are arranged along a straight line in a direction in which X-rays are output; each of the target assemblies includes a target and a supporting member; the target generates X-rays from one of the electron beams generated by the electron-beam generator; and the supporting member supports the target by being disposed adjacent thereto. The electron-beam focusing unit focuses the electron beams onto the targets included in the target assembly group so that X-rays are generated in each of the target assemblies and output along the straight line after passing through the target assemblies.

7 Claims, 9 Drawing Sheets

X-RAY GENERATING DEVICE

BACKGROUND OF THE INVENTION

1. Field of the Invention

The present invention relates to a microfocus X-ray generating device that is used for non-destructive X-ray imaging in the industrial field and for diagnostic applications in the medical field.

2. Description of the Related Art

It is known that X-rays are used for non-destructive testing in the industrial field and for radiography in the medical field because the internal structure of an object can be observed by utilizing the high penetrability of X-rays.

The resolution of an X-ray radiography depends, among other things, on the size of the radiation source of X-rays. Therefore, in order to observe a very small internal structure, a microfocus X-ray generating device that has a very small radiation source needs to be used.

In order to increase the brightness of an X-ray radiograph, the amount of X-ray radiation needs to be increased.

Traditionally, the amount of X-ray radiation has been increased by increasing the current of an electron beam that is made incident on a target.

Japanese Patent Laid-Open No. 8-96986 describes an X-ray generating device in which the amount of X-ray radiation is increased by using a multilayer target. In Japanese Patent Laid-Open No. 8-96986, a target (as illustrated in FIGS. 9A and 9B) is made from a silicon wafer or the like so as to form a thin-film portion. The thin-film portion is made thinner than other portions of the target so that an electron beam can pass therethrough. A multilayer target is formed by stacking the targets by using the thicker portions as spacers. An electron beam is made incident on the thin-film portion of each target of the multilayer target so as to generate multiple-interaction X-rays, whereby X-rays having high energy are generated.

However, in existing microfocus X-ray generating devices, when a high current electron beam is made incident on a very small focal spot, a target can be damaged and various adverse effects, such as a decrease in the degree of vacuum inside the device, are produced. Therefore, it is difficult to reduce the size of the radiation source while increasing the amount of X-ray radiation.

In the X-ray generating device described in Japanese Patent Laid-Open No. 8-96986, which uses a multilayer target, an electron beam is diffused when the electron beam passes through each of the targets included in the multilayer target. Therefore, the larger the number of targets in the multilayer target, the larger becomes the size of a focal spot formed on a target that is located on a side on which X-rays are output. As a result, it is difficult to reduce the size of the radiation source. Moreover, the diameter of an electron beam increases when the current of the electron beam increases because electrons repel each other owing to the charge thereof. Also in this respect, it is difficult to reduce the size of radiation source while increasing the amount of X-ray radiation.

SUMMARY OF THE INVENTION

The present invention provides an X-ray generating device including a very small radiation source having a size in the order of micrometers and that is capable of generating a large amount of X-ray radiation.

An X-ray generating device according to the present invention includes an electron-beam generator that generates electron beams; a target assembly group including a plurality of target assemblies that are arranged in one line in a direction in which X-rays are output, each of the target assemblies including a target and a supporting member, the target generating X-rays from one of the electron beams generated by the electron-beam generator, and the supporting member being disposed adjacent to the target and supporting the target; and an electron-beam focusing unit that focuses the electron beams generated by the electron-beam generator onto the targets included in the target assembly group, wherein the electron-beam focusing unit focuses the electron beams onto intersections of surfaces of the targets and a straight line that extends through the targets, and wherein X-rays that are generated along the straight line are output after passing through the target assemblies that are located on a side toward which the X-rays are output with respect to the position at which the X-rays are generated.

According to the present invention, the electron beams are individually focused on the targets and the generated X-rays are added together, so that the total amount of X-ray radiation can be increased while limiting the current of the electron beam that is incident per target. Therefore, the target does not easily melt, whereby the size of the radiation source can be made very small while increasing the amount of X-ray radiation. Moreover, by limiting the current of the electron beam per target, an increase in the beam diameter due to repulsion between charges of electrons can be suppressed, whereby the size of radiation source can be further reduced.

Further features of the present invention will become apparent from the following description of exemplary embodiments with reference to the attached drawings.

DESCRIPTION OF THE EMBODIMENTS

Hereinafter, embodiments of the present invention will be described.

First Embodiment

Figure 1A:
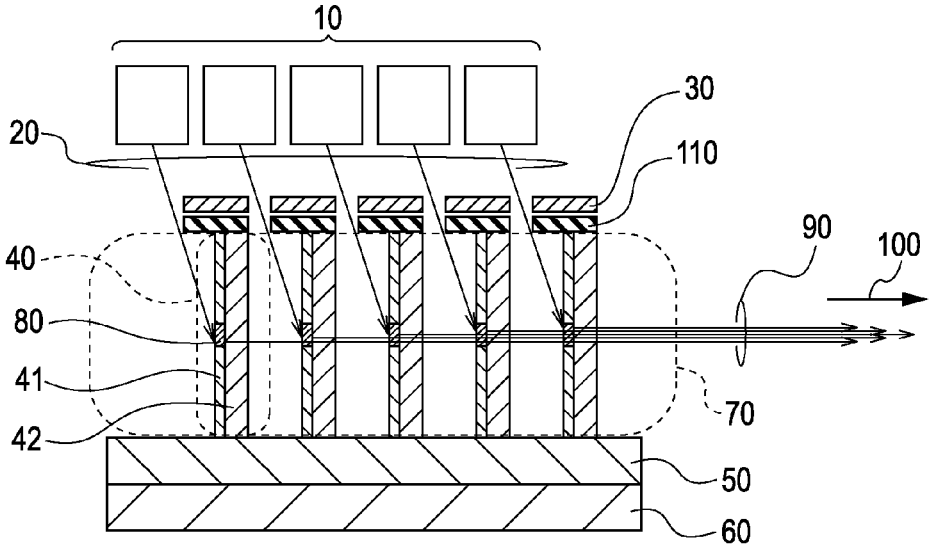
FIGS. 1A and 1B are schematic views of an X-ray generating device according to a first embodiment of the present invention.
Figure 1B:
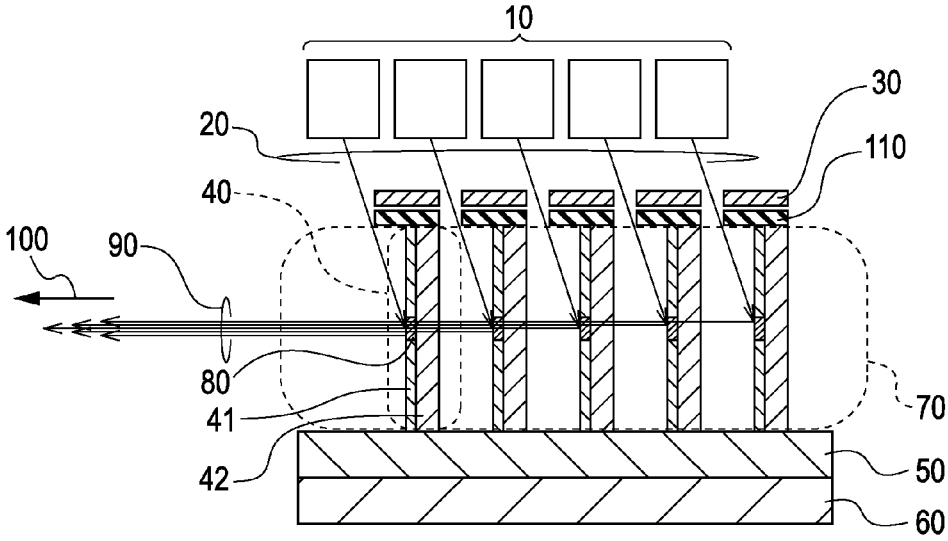

FIGS. 1A and 1B are schematic views of an X-ray generating device according to a first embodiment of the present invention. The main structures of the X-ray generating device illustrated in FIGS. 1A and 1B are the same except that X-rays are output in different directions. Therefore, the following description will be limited to the X-ray generating device illustrated in FIG. 1A. The X-ray generating device according to the first embodiment includes at least one electron-beam generator 10 (or a plurality thereof) that generates electron beams 20, a target assembly group 70 that generates X-rays from the electron beams 20, and electron lenses 30 that are disposed between the electron-beam generator 10 and the target assembly group 70. The electron lenses 30 serve as an electron-beam focusing unit that focuses the electron beams 20 onto focal spots having an appropriate size.

As illustrated in FIG. 1A, the target assembly group 70 includes target assemblies 40 that are arranged in an X-ray output direction 100. Each of the target assemblies 40 (FIG. 2) includes a target 41 that generates X-rays from the electron beam 20 and a supporting member 42 that is disposed adjacent to the target 41 and that supports the target 41. A part of X-rays 90 that are incident on the target 41 is absorbed by the target assembly 40 and the strength of the X-rays 90 decreases. However, most of the X-rays 90 pass through the target assembly 40. In the embodiment, the target assembly group 70 is formed on a substrate 60. A cooling layer 50 may be formed on a surface of the substrate 60 so that heat generated in the target assembly group 70 can be efficiently dissipated to the entirety of the substrate 60.

Electrodes of the electron-beam generator 10 for generating the electron beams 20 may be hot cathodes or cold cathodes. The electron-beam generator 10 generates a plurality of electron beams 20. The number of electrodes of the electron-beam generator 10 for generating the electron beams 20 may be the same as the number of the targets 41 or may be smaller than the number of the targets 41. When the number of the electrodes is smaller than the number of the targets 41, the electron beams 20 generated by the electrodes are split by the electron lens 30 so that the number of electron beams 20 becomes the same as the number of targets 41.

A mechanism that supplies kinetic energy to the electron beam 20 and accelerates the electron beam 20 is provided between the electron-beam generator 10 and the target assembly group 70. For example, a zero voltage is applied to the electron-beam generator 10 and a positive voltage is applied to the target assembly group 70, so that a voltage difference is generated between the electron-beam generator 10 and the target assembly group 70. The voltage difference accelerates the electron beam 20, which is generated by the electron-beam generator 10.

The electron beam 20, which has been accelerated, passes through the electron lens 30, which serves as an electron-beam focusing unit, and is focused onto a focal spot 80, which is a finite region on the target 41.

The electron lens 30 may be integrated with the target assembly group 70 as illustrated in FIG. 1A, or may be integrated with the electron-beam generator 10. The electron lens 30 may be disposed at any appropriate position between the target 41 and the electron-beam generator 10. The position and the size of the focal spot 80 on the target 41 can be adjusted by changing the positional relationship between the electron-beam generator 10 and the electron lens 30 and the focusing condition of the electron lens 30. The focal spots 80 can be formed on the targets 41 so as to be arranged at intersections of the surfaces of the targets 41 and a straight line that extends through the targets 41. The X-rays 90, which include characteristic X-rays of the material of the target 41 and bremsstrahlung X-rays, are generated at each of the focal spots 80.

The X-rays 90 generated at each of the focal spots 80 pass through the target assemblies 40 that are located on a side toward which the X-rays 90 are output with respect to the position at which the X-rays 90 are generated, so that the X-rays 90 are output in the X-ray output direction 100 or in a direction along a straight line that extends through the focal spots 80 of the targets. Thus, the X-rays 90 are added together a number of times equal to the number of the target assemblies 40. In this manner, the X-rays 90 having a high strength can be generated. The X-ray output direction 100 may be a direction toward which the electron beam is incident on the target 41 as illustrated in FIG. 1A, or may be a direction opposite to the direction toward which the electron beam is incident on the target 41 as illustrated in FIG. 1B. Whichever of the directions the X-rays 90 may be output, the present invention can be applied. When X-rays are output in the direction opposite to the direction toward which the electron beam is incident on the target 41, a transmissive target is used as the target 41. Therefore, when the X-ray generating device is used in an X-ray imaging apparatus, the magnification of an image can be increased by moving the target assembly group 70 closer to an X-ray emission window.

With the first embodiment, as described above, a different electron beam 20 is focused onto a focal spot 80 of each of the targets 41; and generated X-rays are added together by multiple-interactions at each target assembly 40. In this manner, the total amount of X-ray radiation can be increased while limiting the current of the electron beam that is incident on each target 41. Therefore, the target 41 is not easily damaged, and the size of the radiation source can be reduced while increasing the amount of X-ray radiation. Moreover, an increase in the beam diameter due to repulsion between charged electrons can be suppressed by limiting the current of the electron beam that is incident on each target 41. Incidentally, the size of radiation source can be further reduced. Furthermore, electron beams are independently focused onto intersections of the surfaces of the targets 41 and a straight line that extends through the targets 41. Therefore, as compared with a case in which one electron beam passes through a plurality of targets, the influence of diffusion of the electron beams caused by the targets 41 is small, whereby very small focal spots can be formed.

Figure 2:
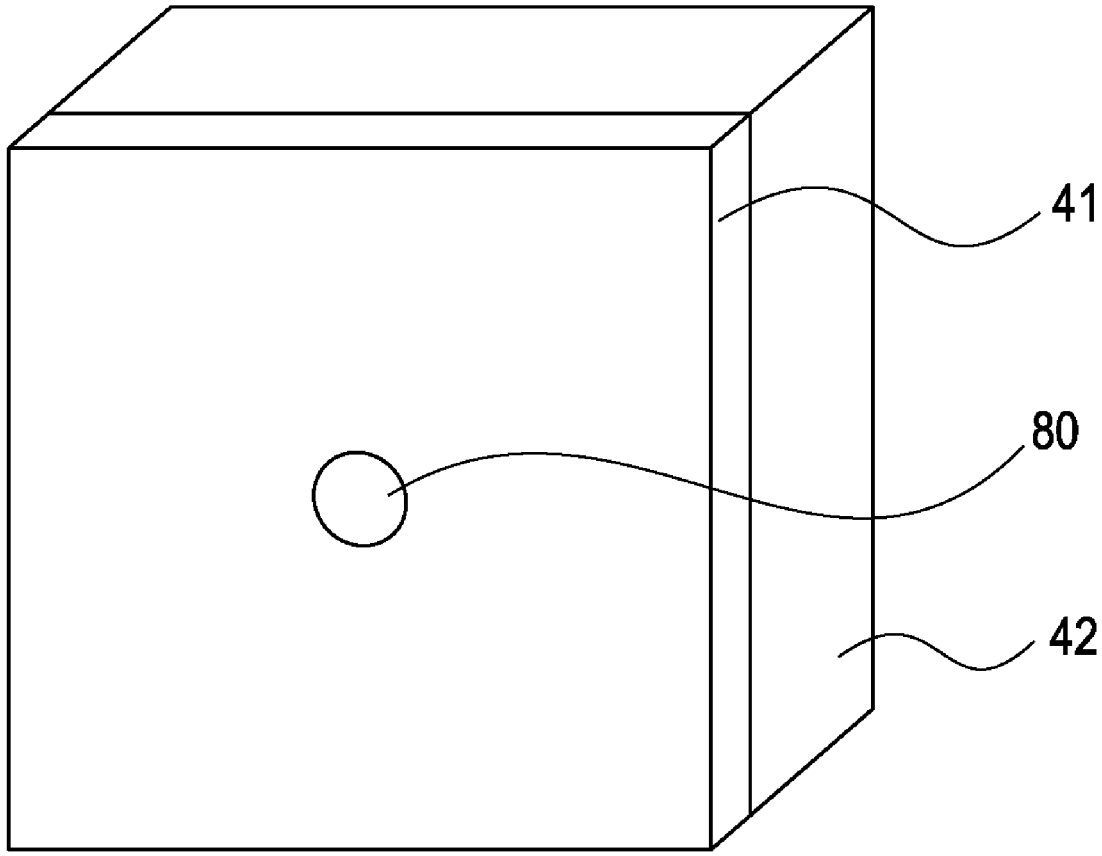
FIG. 2 is a schematic view of an example structure of a target assembly of an X-ray generating device according to the first embodiment of the present invention, in which a target entirely covers one side of a supporting member.

FIG. 2 is a schematic view of an example structure of a target assembly of an X-ray generating device according to the first embodiment of the present invention. In FIG. 2, a target entirely covers one side of a supporting member, but in other arrangements the target may cover only a portion or portions of the supporting member. As illustrated in FIG. 2, the target assembly 40 includes the target 41, which generates X-rays when an electron beam is made incident upon focal spot 80; and includes the supporting member 42, which is made of a material that has a smaller X-ray absorption coefficient than the target 41. For example, the supporting member 42 may be made of light elements or light-element compounds such as carbon, Al, SiC, tetrafluoroethane polymer, polycarbonate, polyimide, or polymethyl methacrylate. By making the supporting member 42 from a material that has a smaller X-ray absorption coefficient than the target 41, generated X-rays can easily pass through the supporting member 42 and can be output. In FIG. 2, by making the thicknesses of the target 41 and the supporting member 42 uniform in the X-ray output direction, X-rays having a uniform strength can be output.

In conventional devices, when an electron beam passes through a supporting member and is incident on a target that is adjacent to the supporting member, the size of a focal spot increases because the electron beam is diffused. In order to maintain the size of a focal spot to be very small, in at least one embodiment of the present invention, the thickness of the supporting member in the incident direction of the electron beam can be made of a thickness that does not allow the electron beam itself to pass through the supporting member, but only allows the X-rays generated at the target to pass.

Figure 3:
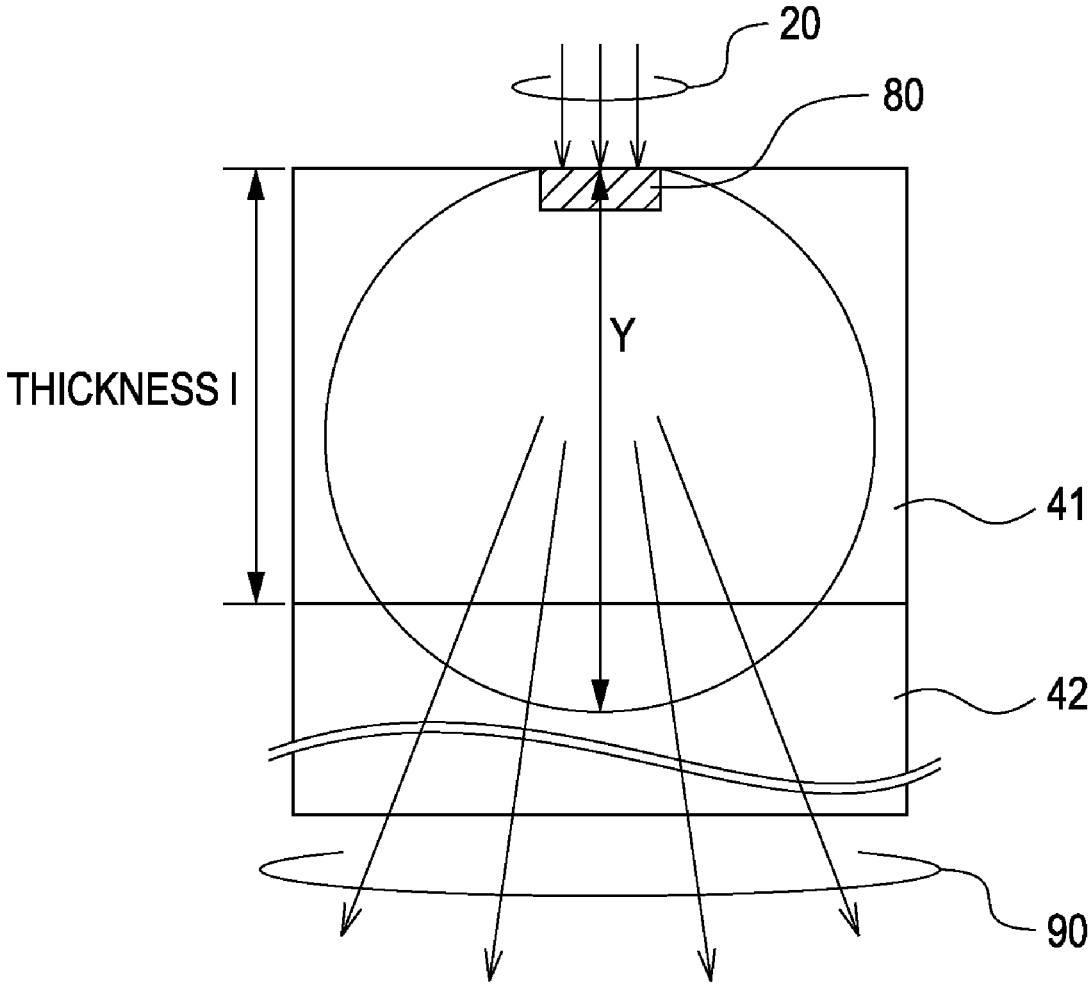
FIG. 3 is a schematic view illustrating the relationship between the penetration depth of an electron beam that is incident on a target and the dimensions of elements of a target assembly.

FIG. 3 is a schematic view illustrating the relationship between the penetration depth of an electron beam that is incident on a target and the dimensions of elements of a target assembly. As illustrated in FIG. 3, the thickness l of the target 41 in the incident direction of the electron beam can be smaller than the average penetration depth Y of the electron beam into the target 41. The average penetration depth Y (nm) of the electron beam into the target 41 is the average depth into which the electron beam penetrates into the target having a density ρ (g/cm$^3$) when the electron beam is accelerated by an acceleration voltage V (kV) and made incident on the target. The average penetration depth Y (nm) can be approximated by the following equation.

$$Y=33.6\times V^{1.76}\times\rho^{-1.13}$$

By making the thickness l of the target 41 in the incident direction of electron beam smaller than the average penetration depth Y of the electron beam into the target, the proportion of X-rays that pass through the target can be increased and thereby the X-rays can be efficiently output. In FIG. 3, for simplicity of illustration, the electron beam is incident in a direction perpendicular to the target. However, when the electron beam is incident on the target at a predetermined angle as in the case of the first embodiment (FIGS. 1A and 1B), the thicknesses in the incident direction of the electron beam may still be designed as described above.

Figure 4A:
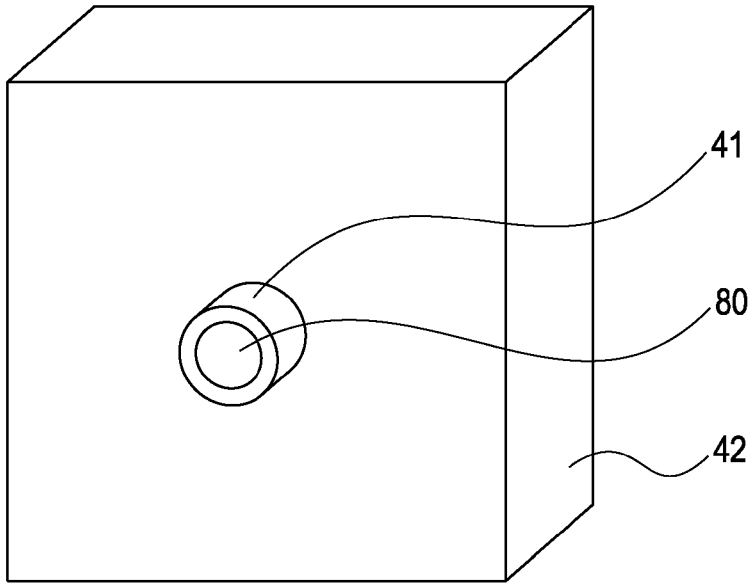
FIG. 4A is a schematic view of an example structure of a target assembly of an X-ray generating device according to the first embodiment of the present invention, in which a target covers a part of a supporting member.
Figure 4B:
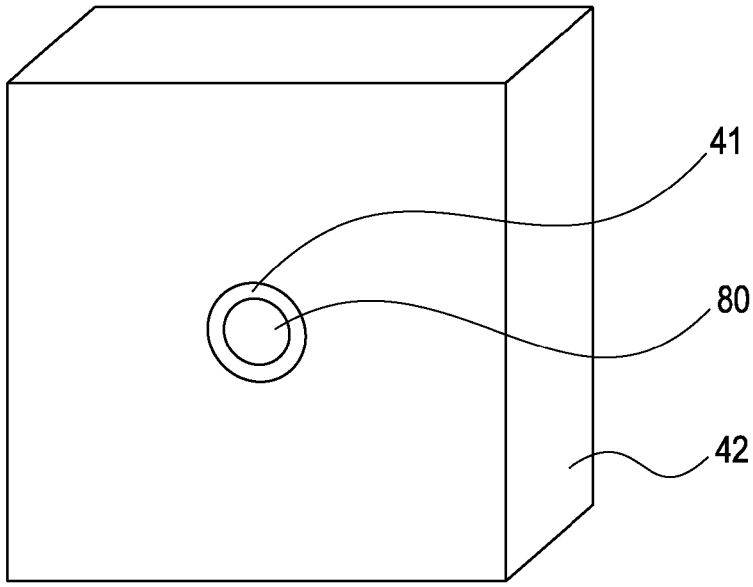
FIG. 4B is a schematic view of an example structure of a target assembly of an X-ray generating device according to the first embodiment of the present invention, in which a target is embedded in a part of a supporting member and a part of the target assembly is exposed.
Figure 5A:
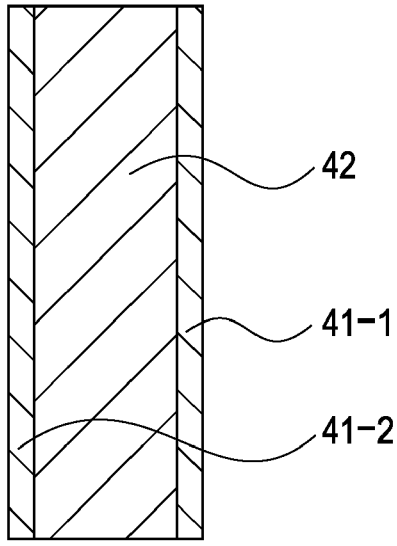
FIGS. 5A and 5B are schematic views of example structures of a target assembly of an X-ray generating device according the first embodiment of to the present invention, in which targets cover both sides of a supporting member.
Figure 5B:
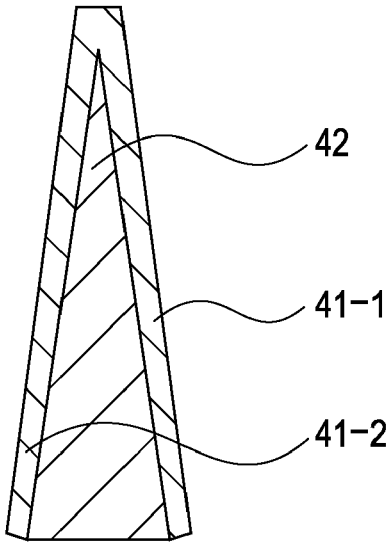

One side of the supporting member 42 may be entirely covered by the target 41 as illustrated in FIG. 2. Alternatively, only a part of one side of the supporting member 42 may be covered by the target 41 having an appropriate shape as illustrated in FIG. 4A. As a further alternative, for example, as illustrated in FIG. 4B, the target 41 may be embedded in a part of the supporting member 42 so as to be exposed with an appropriate shape. By limiting the size of the target 41 as illustrated FIGS. 4A and 4B, even when the electron beam 20 is not sufficiently focused, the area of the region in which X-rays are generated can be made small. Moreover, because the position of the target 41 is determined when the target assembly 40 is assembled, the regions in which X-rays are generated can be arranged on a straight line irrespective of the alignment of the electron beams 20. As illustrated in FIGS. 5A and 5B, targets 41-1 and 41-2 may be respectively disposed on one side of the supporting member 42 toward which X-rays are output and on the other side of the supporting member opposite the side toward which the X-rays are output. With such a structure, the number of components can be reduced and the target assembly group can be made compact, as compared with a case in which the target 41 is disposed on one side of the supporting member 42. When the supporting member 42 has a triangular shape as illustrated in FIG. 5B, the targets 41-1 and 41-2 can be formed on both sides of the supporting member 42 in one step, whereby productivity can be improved.

Second Embodiment

Figure 6A:
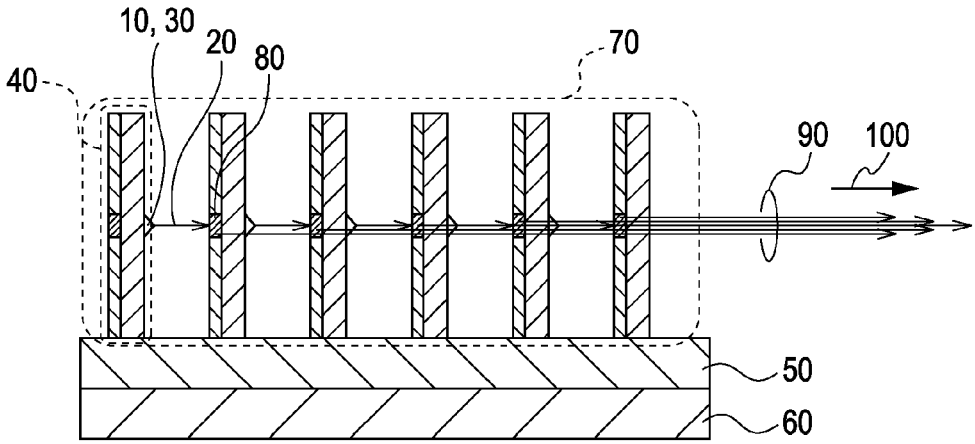
FIGS. 6A and 6B are schematic views of an X-ray generating device according to a second embodiment of the present invention.
Figure 6B:
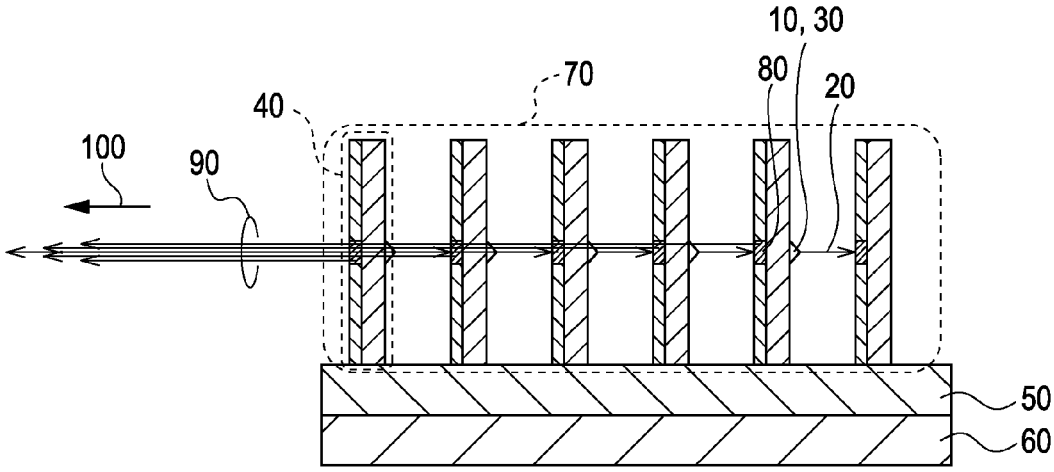

FIGS. 6A and 6B are schematic views of an X-ray generating device according to a second embodiment of the present invention. Embodiments illustrated in FIGS. 6A and 6B are the same except that X-rays 90 are output in a first direction 100 (to the right) in the case of FIG. 6A and in a second direction 100 (to the left) in the case of FIG. 6B. Accordingly, only the case of FIG. 6A will be mainly described below. The second embodiment differs from the first embodiment mainly in that electron-beam generators 10 and electron lenses 30 are integrated in target assemblies 40. In the first and second embodiments like reference numbers generally indicate identical, structurally similar or functionally similar elements.

Figure 7:
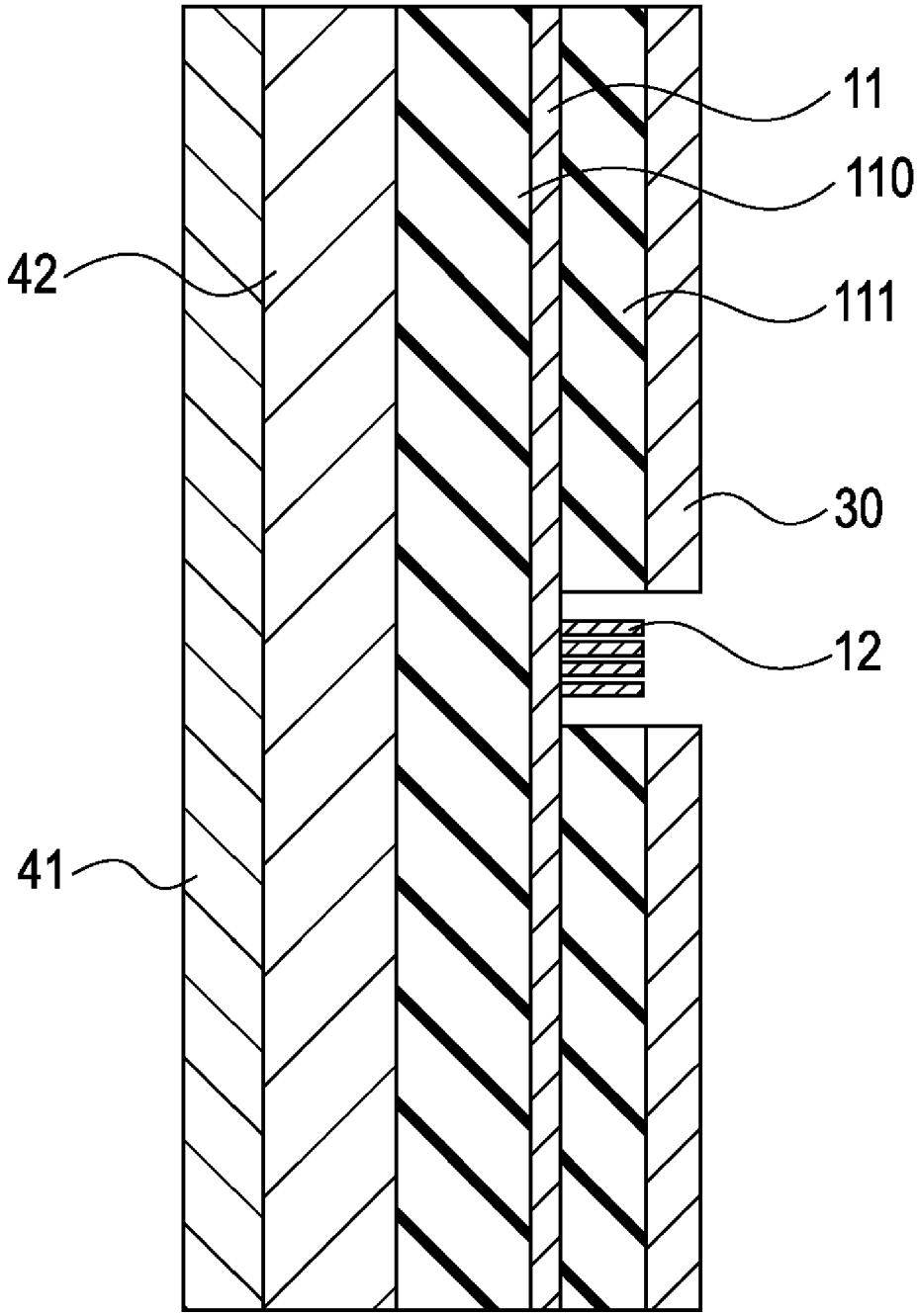
FIG. 7 is a schematic view of a target assembly of the X-ray generating device according to the second embodiment of the present invention.

FIG. 7 is a schematic view of the target assembly 40 in the second embodiment. The target assembly 40 includes a target 41 disposed on a side of a supporting member 42. The target 41, for example, may cover all of the side of the supporting member 42 as in the case of FIG. 2 or a part of the side of the supporting member as in the cases of FIGS. 4A and 4B.

As illustrated in FIG. 7, on a side of the supporting member 42 opposite to the side on which the target 41 is present, a first insulation layer 110, a wiring layer 11, at least one micro electron source 12 (electron-beam generator), a second insulation layer 111, and an electron lens 30 are formed in this order. Referring to FIGS. 6A and 6B, a cooling layer 50 for cooling the target assembly 40 may be formed between the target assembly 40 and the substrate 60.

Referring back to FIG. 7, the first and second insulation layers 110 and 111, respectively, are made of a material having a low X-ray absorption coefficient, such as $SiO_2$, $Al_2O_3$, or polyimide.

The wiring layer 11 is made of a conductive material having a low X-ray absorption coefficient, such as Al.

The micro electron source 12 is a cold cathode that has a pointed protrusion having a columnar, needle-like, conical or pyramidal shape. The micro electron source 12 is made of a conductive material or a low-work-function material having a low X-ray absorption coefficient, such as carbon or Si, by using methods such as etching, rotational deposition (Spindt method), and nanoimprinting. The protrusion has a pointed tip having a size in the range of several nanometers to several tens of nanometers. Alternatively, the micro electron source 12 may be made of a material having a pointed protrusion structure, such as a carbon nanotube, a metal oxide nanotube, a carbon nanowall, or a carbon nanohorn.

The electron lens 30 has an opening through which an electron beam 20, which has been emitted from a protrusion of the micro electron source 12, can reach another target assembly 40. The insulation layer 111 is formed on the wiring layer 11.

Referring again to FIGS. 6A and 6B, between the electron-beam generator 10 (which includes the micro electron source 12) of a target assembly 40 and another target assembly 40 facing the electron-beam generator 10, a mechanism for providing kinetic energy to electrons included in the electron beam 20 so as to accelerate the electrons is disposed. Electrons are generated by the electron-beam generator 10, accelerated by the mechanism, and focused by the electron lens 30 onto a focal spot 80, which is a finite region on an adjacent target assembly 40 facing the electron beam generator 10. By adjusting the positional relationship between the electron-beam generators 10 disposed on the supporting members 40, the focal spots 80 on the targets 41 can be arranged on intersections of the targets 41 and a straight line that extends through the targets 41.

The X-rays 90, which have been generated at the focal spot 80 on each of the targets 41, pass through the target assemblies 40 that are located on a side toward which X-rays are output with respect to the position at which the X-rays are generated, and are output in the X-ray output direction 100, or a direction along the straight line that extends through the focal spots 80 of the targets 41. In this manner, the X-rays 90 are added together a number of times equal to the number of the target assemblies 40 so that stronger X-rays can be used. The X-ray output direction 100 may be a direction toward which the electron beam is incident on the target 41, or may be a direction opposite to the direction toward which the electron beam is incident on the target 41. When X-rays are output in the direction opposite to the direction toward which the electron beam is incident on the target, a transmissive target is used. Therefore, when the X-ray generating device is used in an X-ray imaging apparatus, the magnification of an image can be increased by moving the target assembly group closer to an X-ray emission window.

In the second embodiment, as described above, the electron beams are independently focused on the targets and the generated X-rays are added together. Therefore, the total amount of X-ray radiation can be increased while limiting the current of the electron beam that is incident on each target. Moreover, electron beams are independently focused onto intersections of the surfaces of the targets and the straight line that extends through the targets. Therefore, as compared with a case in which one electron beam passes through a plurality of targets, the influence of diffusion of the electron beams caused by the targets is small. Accordingly, very small focal spots can be formed. By limiting the current of the electron beam per target, an increase in the beam diameter due to repulsion between charges of electrons can be suppressed, whereby the sizes of the focal spots can be reduced.

In the second embodiment, the electron-beam generator 10, which is the micro electron source 12, and the electron lens 30 are integrated in the target assembly 40, so that the electron-beam generator 10, the electron lens 30, and the target 41 are positioned close to each other. Therefore, in addition to the benefits obtained by the first embodiment, diffusion of the electron beams 20 is suppressed and the sizes of the focal spots can be more easily made smaller.

Except for the points described above, configurations, structures, and materials that can be used in the first embodiment can be used in the second embodiment, and benefits and advantages in the second embodiment similar to those of the first embodiments can be obtained.

EXAMPLE 1

Next, a first example of the X-ray generating device according to the first embodiment of the present invention will be described. To be specific, an example of making the X-ray generating device illustrated in FIG. 1A, which is suitable for a case in which electrons are accelerated to 60 keV and collide with a molybdenum target, will be described.

First, the target assembly 40 was fabricated. The average penetration depth Y of an electron beam of 60 keV into molybdenum is about 5 μm. As the target 41, a molybdenum thin film having a thickness of 5 μm was formed on a silicon wafer by electron beam deposition. The silicon wafer, which served as the supporting member 42, was a double-side polished silicon wafer having a diameter of 4 inches and a thickness of 200 μm. Subsequently, the target assemblies 40 were made by cutting the silicon wafer with a dicing saw into segments each measuring 10 mm per side. The target 41 can be formed on the supporting member 42 by photolithography; dry etching; various existing deposition methods such as sputtering, vapor deposition, CVD, electroless plating, and electrolytic plating; nanoimprinting; and the like.

Next, the target assembly 40 was joined to the substrate 60. To be specific, by using a precision cutting machine, twenty grooves each having a depth of 2 mm, a width of 210 μm, and a length of 10 mm were formed at a pitch of 1 mm in an oxygen-free copper substrate measuring 20 mm per side and having a thickness of 5 mm. The oxygen-free copper substrate served as the substrate 60. Subsequently, gold plating was applied to a surface of the copper substrate. The target assemblies 40 were attached to the grooves in the copper substrate in such a manner that the molybdenum surfaces of the target assemblies 40 face one direction. The target assemblies 40 and the copper substrate were heated to a temperature equal to or higher than the eutectic temperature of gold and silicon (363° C.), so that the copper substrate and the target assemblies 40 were joined to each other. The first example did not include the cooling layer 50.

The electron lens 30 can be made by forming a chromium thin film, for example, on a silicon wafer by using an existing deposition method and then forming a through hole by using an existing etching method. A silicon surface of the electron lens 30 (a surface opposite to the surface on which the chromium thin film is formed) was joined to the target assembly 40 by eutectic bonding, so that the X-ray generating device according to the first embodiment was obtained.

Figure 8:
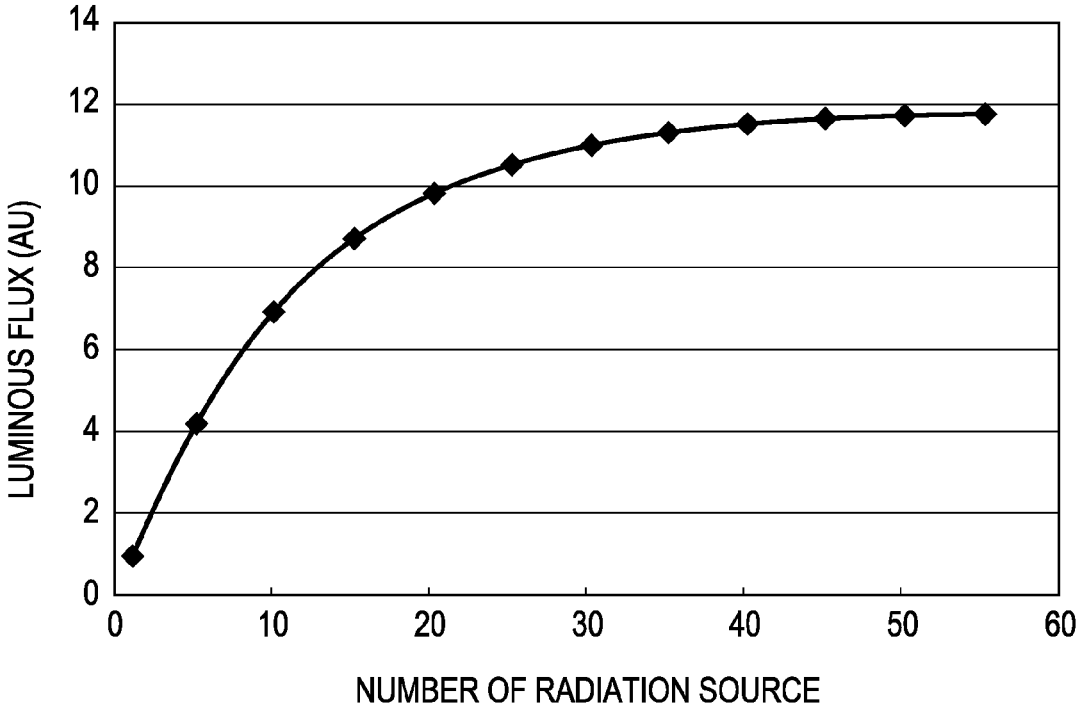
FIG. 8 is a graph illustrating the relationship between the number of target assembly groups and the output amount of X-rays.
Figure 9A:
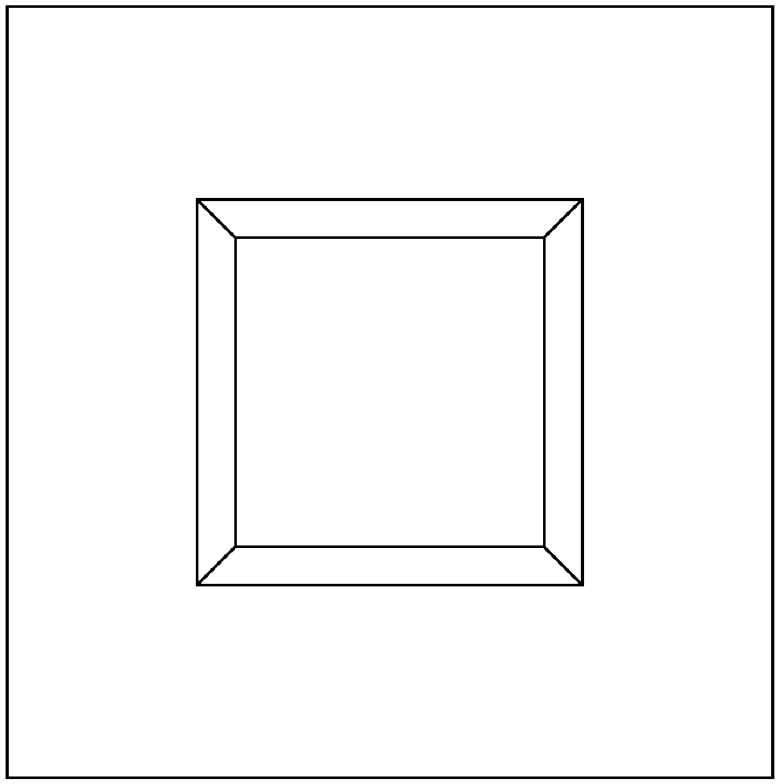
FIG. 9A is a schematic plan view of a target included in a multilayer target.
Figure 9B:
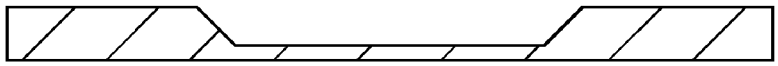
FIG. 9B is a schematic sectional view of the target included in the multilayer target.

When an electron beam having an energy of 30 keV was incident on a molybdenum target, the molybdenum target generated characteristic X-rays of 17.5 keV. For example, when molybdenum targets each having a thickness of 3 μm were arranged as illustrated in FIGS. 1A and 1B, and characteristic X-rays of 17.5 keV was output from each of the targets in the direction in which the targets were arranged. The amount of X-rays that were output were calculated as illustrated in FIG. 8. That is, when the number of the target assemblies 40 was increased beyond a certain extent, an increase in the amount of X-rays that were generated by the target assemblies 40 became close to the amount of X-rays that were absorbed by the target assemblies 40, and finally the amount of X-rays that were output saturated. Therefore, under the conditions described above, the appropriate number of molybdenum targets was equal to or smaller than about 50. Thus, the number of targets can be determined on the basis of the saturation amount of X-rays that can be output under the conditions.

EXAMPLE 2

Next, a second example of the X-ray generating device according to the second embodiment of the present invention will be described. To be specific, an example of making the X-ray generating device illustrated in FIG. 6A, which is suitable for a case in which electrons are accelerated to and 30 keV and collide with a molybdenum target, will be described. As illustrated in FIG. 6A, the micro electron source 12, which serve as the electron-beam generator 10, and the electron lens 30 are integrated in the target assembly 40.

First, the target assembly 40 was fabricated. The average penetration depth Y of an electron beam of 30 keV into molybdenum is about 2 μm. As the target 41, a molybdenum thin film having a thickness of 2 μm was formed on a silicon wafer by electron beam deposition. The silicon wafer, which served as the supporting member 42, was a double-side polished silicon wafer having a diameter of 4 inches and a thickness of 200 μm. Next, as the insulation layer 110, a both-side polished quartz substrate having a thickness of 500 μm was joined to the back surface of the silicon wafer by anode coupling. An aluminum thin film having a thickness of 200 nm serving as the wiring layer 11, an iron thin film having a thickness of 5 nm serving as a catalyst for synthesizing a carbon nanotube (CNT), an $SiO_2$ thin film having a thickness of 200 nm serving as the insulation layer 111, and a chromium thin film having a thickness of 200 nm serving as the electron lens 30 were formed in this order on the quartz substrate by sputtering. A resist was spin coated on the chromium thin film, and patterning of 5×5 matrix of openings arranged at a pitch of 10 mm and each having a diameter 10 μm was performed by photolithography. The chromium thin film and the $SiO_2$ thin film were removed by etching, and a surface of the iron thin film was exposed. The CNT was grown on the surface of the iron thin film by plasma enhanced chemical vapor deposition, so that the micro electron source 12 was made. Subsequently, the quartz substrate was cut into segments measuring 10 mm per side with a dicing saw. Thus, the micro electron source 12 and the electron lens 30 were integrated on the target assembly 40.

Next, the target assembly 40 was joined to the substrate 60. First, by using a precision cutting machine, twenty grooves each having a depth of 2 mm, a width of 210 μm, and a length of 10 mm were formed at a pitch of 1 mm in an oxygen-free copper substrate measuring 20 mm per side and having a thickness of 5 mm. The oxygen-free copper substrate served as the substrate 60. Subsequently, gold plating was applied to a surface of the copper substrate. The target assemblies 40 were attached to the grooves in the copper substrate in such a manner that the molybdenum surfaces of the target assemblies 40 faced one direction. The target assemblies 40 and the copper substrate were heated and joined to each other, so that the X-ray generating device according to the second embodiment was obtained. The second example did not include the cooling layer 50. As with the first example, the number of targets can be determined on the basis of the saturation amount of X-rays that can be output under the conditions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-175392 filed Jul. 28, 2009, which is hereby incorporated by reference herein in its entirety.

What is claimed is:

1. An X-ray generating device comprising:

an electron-beam generator that generates electron beams;

a target assembly group including a plurality of target assemblies that are arranged in one line in a direction in which X-rays are output, each of the target assemblies including a target and a supporting member, the target generating X-rays from one of the electron beams generated by the electron-beam generator, and the supporting member being disposed adjacent to the target and supporting the target; and an electron-beam focusing unit that focuses the electron beams generated by the electron-beam generator onto the targets included the target assembly group, wherein the electron-beam focusing unit focuses the electron beams onto intersections of surfaces of the targets and a straight line that extends through the targets, and wherein X-rays that are generated along the straight line are output after passing through the target assemblies that are located on a side toward which the X-rays are output with respect to the position at which the X-rays are generated.

2. The X-ray generating device according to claim 1, wherein each supporting member is made of a material that has an X-ray absorption coefficient lower than that of the target.

3. The X-ray generating device according to claim 1, wherein a thickness of each supporting member in an incident direction of a corresponding one of the electron beams is a thickness that does not allow the electron beam to pass through the supporting member.

4. The X-ray generating device according to claim 1, wherein a thickness of each target in an incident direction of a corresponding one of the electron beams is smaller than an average penetration depth of the electron beam into the target, the average penetration depth being represented by the following equation $$Y=33.6\times V^{1.76}\times\rho^{-1.13},$$

where Y is the average penetration depth (nm) of the electron beam, V is an acceleration voltage (kV), and ρ is a density ($g/cm^3$) of the target.

5. An X-ray generating device according to claim 1, wherein each target is disposed on a side of a corresponding one of the supporting members toward which X-rays are output and on another side of the supporting member opposite to the side toward which the X-rays are output.

6. The X-ray generating device according to claim 1, wherein the electron beams generated by the electron-beam generator are incident on the targets though spaces between the target assemblies that are located adjacent to each other in the target assembly group.

7. The X-ray generating device according to claim 1, wherein the electron-beam generator includes a micro electron source formed on a corresponding one of the supporting member, and an electron beam generated by the micro electron source is incident on a corresponding one of the targets that faces the micro electron source.

* * * * *